US005799327A

United States Patent [19]

Clevenhagen

[11] Patent Number: 5,799,327

[45] Date of Patent: Sep. 1, 1998

[54] BASEBALL OR SOFTBALL GLOVE CONSTRUCTED TO MAINTAIN BALL-CATCHING POCKET

[75] Inventor: Robert L. Clevenhagen, Ava, Mo.

[73] Assignee: Rawlings Sporting Goods Company, Inc., St. Louis, Mo.

[21] Appl. No.: 745,161

[22] Filed: Nov. 7, 1996

[51] Int. Cl.[6] ..... A41D 13/08

[52] U.S. Cl. ..... 2/19

[58] Field of Search ..... 2/19, 161.1, 18, 2/20, 159, 161.6, 161.5, 169, 163; D29/115

[56] References Cited

U.S. PATENT DOCUMENTS

| | | | |
|---|---|---|---|
| 3,076,971 | 2/1963 | Steinman | 2/19 |
| 3,528,107 | 9/1970 | Rosenbaum | 2/19 |
| 5,253,365 | 10/1993 | Clevenhagen | 2/19 |
| 5,448,775 | 9/1995 | Yamada et al. | 2/19 |
| 5,592,688 | 1/1997 | LaRonge et al. | 2/19 |

FOREIGN PATENT DOCUMENTS

| | | | |
|---|---|---|---|
| 112870 | 8/1982 | Canada | 2/19 |

*Primary Examiner*—C. D. Crowder
*Assistant Examiner*—Larry D. Worrell, Jr.
*Attorney, Agent, or Firm*—Stinson, Mag & Fizzell, P.C.

[57] ABSTRACT

A baseball or softball glove constructed to maintain the ball-catching pocket and to facilitate closure of the glove having an inverted V-shaped notch generally located at the center of the heel. The inverted V-shaped shaped notch assists in the opening and closing of the glove by creating a flex line extending up from the apex of the inverted V-shaped notch generally midway between the sides of the glove and through the ball-catching pocket.

16 Claims, 3 Drawing Sheets

BASEBALL OR SOFTBALL GLOVE CONSTRUCTED TO MAINTAIN BALL-CATCHING POCKET

BACKGROUND OF THE INVENTION

The present invention relates to a baseball or softball glove constructed to maintain the ball-catching pocket and to facilitate closure of the glove having an inverted V-shaped notch generally located at the center of the heel. The invention is constructed with young people and those with little hand strength in mind, although the glove has universal application. Gloves constructed in conventional fashion are difficult to close, especially when new. Generally, such new gloves require hand-rubbing with oils and much play to break them in and ease closure. A typically constructed glove tends to close or "break" along a flex line which starts at one side of the glove generally adjacent the bottom of the glove and extends diagonally across the ball-catching pocket of the glove toward the web of the glove as described by applicant Clevenhagen in U.S. Pat. No. 5,253,365, at FIG. 1. Applicant's present invention is an improvement over the glove taught by the above patent as well as that disclosed in Yamada et al. U.S. Pat. No. 5,448,775, assigned to Mizuno Corporation of America, in that: (a) the inverted V-shaped notch greatly enhances the effect of the two lines of lacing previously taught by applicant, and (b) the location of the inverted V-shaped notch generally at the center of the heel results in a flex line more advantageously located in the center of the ball-cathching pocket and assists in a closure of the glove so that both sides of the glove uniformly meet. This is in contrast with that taught by Yamada et al. where the inverted V-shaped notch is located between the finger stall for the player's fourth digit and the hand receiving opening. Such placement creates a flex line to the right of the ball-catching pocket and results in the sides of the glove not uniformly meeting upon closure. An illustration of this type of flex line is shown in FIG. 1 of U.S. Pat. No. 5,253,365. Such a flex line diminishes the effective surface area of the ball-catching pocket. Therefore, a need exists for a glove which is relatively easy to flex and close having means to create a flex line generally at the center of the glove and ball-catching pocket so as to provide maximal ball-cathching surface area in small and large gloves alike.

SUMMARY OF THE INVENTION

Generally, the glove comprises a front panel forming the front wall of the glove and a back panel forming the back wall of the glove. The front and back panels are secured together at peripheral margins of the glove to form a glove shell having a top, bottom and opposite sides, a thumb stall for receiving the thumb of the hand, and finger stalls for receiving the fingers of the hand. A web is located between the thumb stall and said finger stalls. Means is provided for securing the web to the thumb stall and finger stalls. The front panel has an outside face forming the front surface of the glove and an inside face. A liner in the shell comprises a palm liner panel on the inside face of the front panel. The front panel and the palm liner have lower edge margins generally in registry with one another to form a heel of the glove extending between the opposite sides of the glove. The outside face of the front panel has a central portion forming a ball-catching pocket located above the heel of the glove and below the web and the finger stalls. The center of the heel has an inverted V-shaped notch with front notch portions in the front and back panel an palm liner panel, respectively. The inverted V-shaped notch assists in the opening and closing of the glove by creating a flex line extending up from an apex of said notch generally midway between the sides of said glove and through the ball-catching pocket. The inverted V-shaped notch cooperates with flexing means comprised of two lines of fastening laces to enable the glove to readily flex along a flex line extending up from the heel of the glove, generally midway between the sides of the glove and through the ball-catching pocket. The heel has little or no padding at the flex line to facilitate closing of the glove along the flex line.

The objects of this invention are as follows: (a) providing a baseball or softball glove which is constructed to maintain the ball-catching pocket and to facilitate closure of the glove; (b) providing a baseball or softball glove which is constructed to facilitate closure of the glove around the ball-catching pocket; (c) providing a glove designed for children and others with little hand strength; (d) providing a glove having means for producing a flex line generally in the center of the glove so the sides of the glove uniformly meet; (e) providing a glove requiring less "break in" time; (f) providing a glove with greater effective ball-catching surface area; (g) providing a glove with means for improving the formation of a ball-catching pocket; (h) providing a glove having flex means which cooperates with two lines of lacing to produce a flex line generally in the center of the glove; and (i) providing a glove which is attractive, durable and economical to manufacture.

Other advantages and objects of the invention will become apparent from the following description with reference to the accompanying drawings.

DETAILED DESCRIPTION OF THE PREFERRED EMBODIMENT

Figure 1:
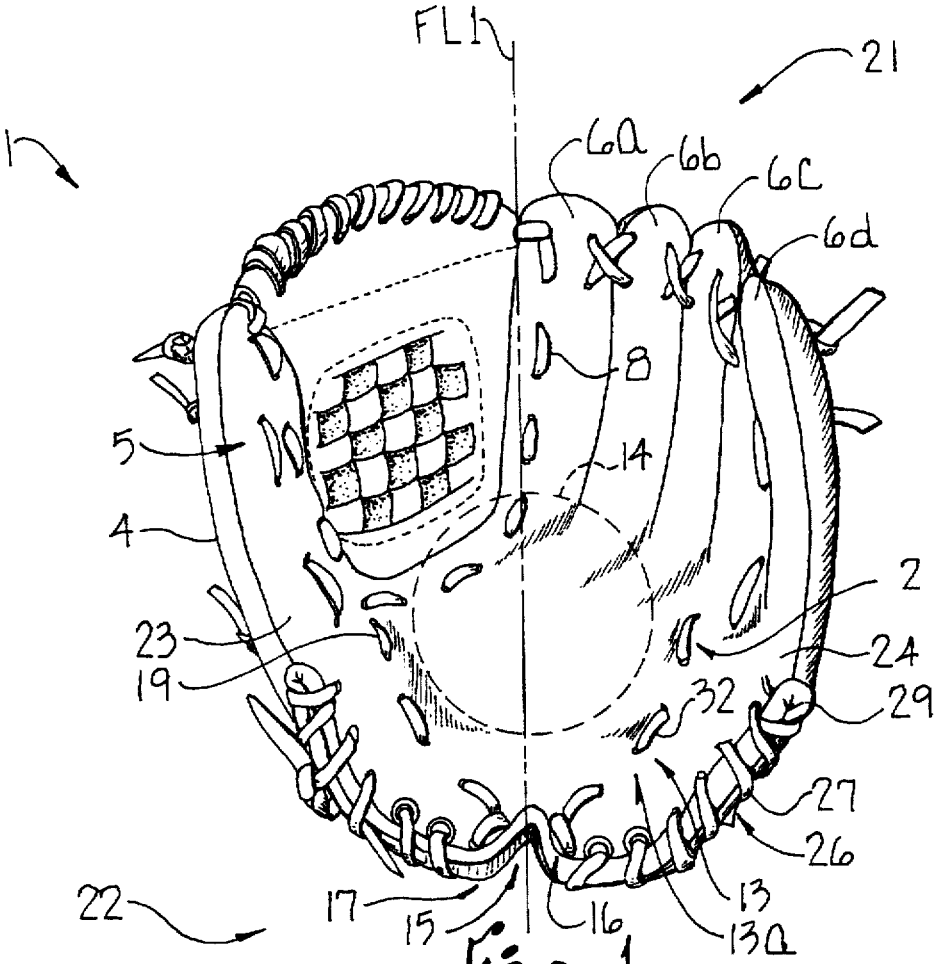
FIG. 1 is a front elevational view of a glove constructed in accordance with the present invention.
Figure 3:
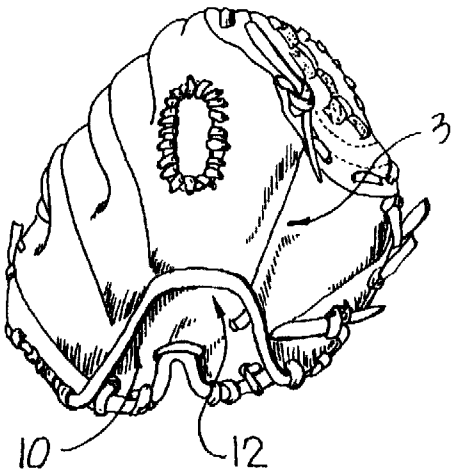
FIG. 3 is a rear elevational view of the present invention.
Figure 2:
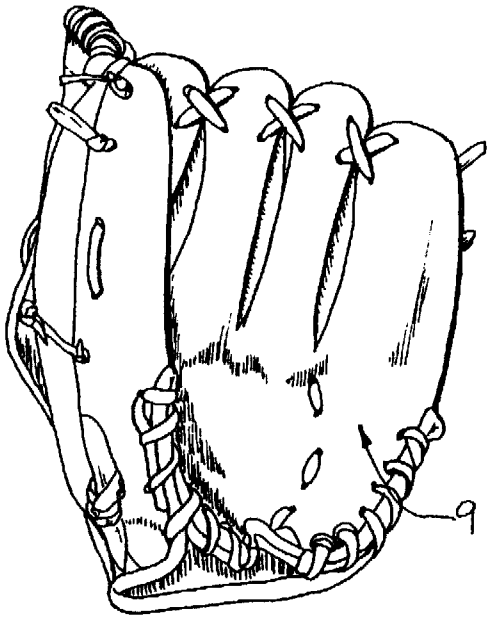
FIG. 2 is a side elevational view of a glove of the present invention.
Figure 4:
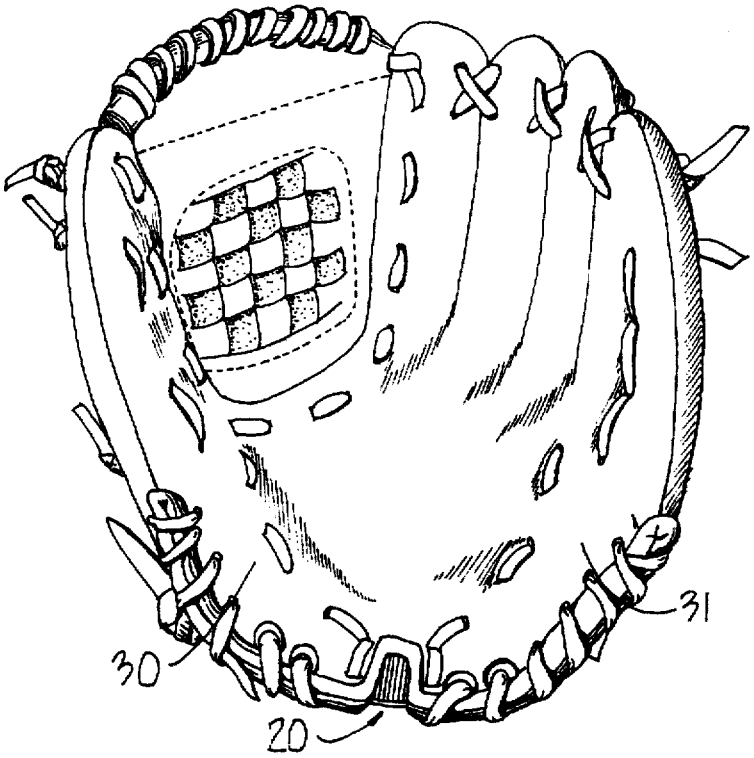
FIG. 4 is a front elevational view of an alternative embodiment of the invention showing the covering over the inverted V-shaped notch.

Referring now to the drawings, and particularly to FIG. 1, there is generally indicated at 1 a glove constructed in accordance with the present invention to maintain the ball-catching pocket and to facilitate closure of the glove. The glove comprises a front panel 2 forming the front wall of the glove and a back panel 3 forming the back wall of the glove. The front and back panels are secured together, preferably sewn, at peripheral margins of the glove to form a glove shell 4 having a top side 21, a bottom side 22, and opposite sides 23, 24, a thumb stall 5 and finger stalls **6*a*–6*d*. While a fielder's glove having four finger stalls is shown in the drawings for purposes of illustration, this invention is also applicable to gloves and mitts having one or more finger stalls. A web 7 is disposed between the thumb stall 5 and the first finger stall 6*a* and is secured in place by conventional lacing 8. The front panel 2 has an outside face 9 forming the front surface of the glove and an inside face 10. Disposed in the glove shell 4 and attached to inside face 10 is a palm liner 12 for engagement by the palm of the hand when the hand is in the glove shell 4**.

The front panel 2 and the palm liner 12 of the glove have lower edge margins generally in registry with one another to form a heel 13 of the glove extending between opposite sides 23, 24 of the glove adjacent to the bottom of the glove. Stitching 26 and lacing 27 passing through eyelets 28 secure the front panel and the palm liner 12 together at the bottom of the glove. This lacing 27 and stitching 26 also extend partway up the sides 23, 24 to secure the front and back glove panels 2, 3 to one another. Suitable trim 29 is provided to cover raw edges of the glove. The outside face 9 of the front panel 2 has a central portion forming a ball-catching pocket 14 located above the heel 13 of the glove generally adjacent to the lower part of the web 7 and finger stalls 6*a*–6*d*.

To provide additional protection and shock absorbing capabilities, elongate thumb pad 30 and finger pads 31 are disposed in glove shell 4 between the front panel 2 and palm liner 12 extending from generally adjacent the top 21 of the glove to generally adjacent the bottom 22 of the glove adjacent opposite sides 23, 24 of the glove. These pads are spaced apart at the bottom of the glove to leave a relatively narrow unpadded portion 13*a* of the heel 13 generally midway between the sides of the glove. This unpadded portion, in combination with an inverted V-shaped notch 15, enable ready flexing of the glove along a flex line FL1 extending up from the central heel portion 13*a* of the glove in a substantially straight line through the ball-catching pocket 14 and adjacent the juncture between the first finger stall 6*a* and the web 7 of the glove. This flex line FL1 generally corresponds to the center line of the glove.

The inverted V-shaped notch 15 is located generally at the center of the heel 13 and comprises front notch portion 16 and back notch portion 17 in said front panel 2 and said palm liner 12, respectively. The inverted V-shaped notch 15 creates a flex line FL1 extending up from an apex of the inverted V-shaped notch 15 generally midway between the sides and through the ball-catching pocket 14. Although not required to achieve the desired effect of creating flex line FL1, two lines of fastening lacing 19, 32 are preferably stitched through the front panel 2 and palm liner 12 and are arranged in a generally V-shaped formation, with the apex of the V disposed generally along the outside edges of inverted V-shaped notch 15, and with the legs of the V diverging upwardly away from the heel 13 on opposite sides of the ball-catching pocket 14 so that the latter is disposed generally between the two legs of the V. The two lines of lacing 19, 32 also function to hold the thumb and finger pads 30, 31 in place. The two lines of lacing 19, 32 are preferably formed of a single piece of leather lace (although other materials could be used), the ends of which form the upper ends of the V-shaped formation and which are knotted on the outside of the back panel 3 of the glove to secure the lacing in place.

Inverted V-shaped notch 15 preferably has a notch covering 20 which is affixed, preferably sewn, between front and back notch portions 16 and 17. Notch covering 20 is comprised of leather, vinyl or like materials and preferably contains foam padding incorporated therein. The purpose of notch covering 20 is to protect the part of the player's hand exposed by inverted V-shaped notch 15 from blows when fielding balls.

The inverted V-shaped notch 15, the V formation of the lacing 19, 32, and the lack of any substantial padding at both the apex of the lacing and the interior of the inverted V-shaped notch 15, cooperate to form flex line FL1 which generally corresponds with the center of the glove. This is advantageous for a number of reasons. First, the force required to close the glove along this center flex line FL1 is less than that required to close the glove along a conventional side flex line as illustrated in FIG. 1 of applicant's U.S. Pat. No. 5,253,365. Closing the glove of conventional design requires flexing or bending the back of the glove across the knuckle area, whereas the center break glove of this invention eliminates this flexing and thus reduces the force required for closing. Second, children are more readily able to close the glove because they can place their fingers on opposite sides of the center flex line FL1 even though their fingers are very short, whereas in a side-break glove, their fingers may not be long enough to be placed on opposite sides of the break, thereby making it very difficult to close or break the glove. Third, the center flex line FL1 tends to direct the ball being caught toward the center of the glove rather than toward the web of the glove as in conventional side-break gloves. This, therefore, maximizes the effective ball-catching area of the glove.

It should be understood that various changes to the present invention may be made by the ordinarily skilled artisan without departing from the spirit of the present invention which is represented in the claims below. Thus, the ordinarily skilled artisan will appreciate that this disclosure presents an example of the invention and is not meant to limit the invention as presented in the claims in any way.

What is desired to be claimed and secured as Letters Patent is as follows:

1. A baseball or softball glove having top, bottom and opposing sides, wherein said glove comprises:

(a) a front panel forming the front wall of the glove;

(b) a back panel forming the back wall of the glove, wherein the front and back panels are secured together along peripheral edges to form an enclosed glove shell having a thumb stall for receiving the thumb of a user, at least one finger shall for receiving one or more fingers of a user and a hand receiving opening formed between a bottom edge of the front and back panels to enable a user to insert his/her hand into the glove;

(c) a web located between the thumb stall and said finger stall;

(d) a heel extending along a bottom of said front panel between opposing sides of the glove and adjacent the hand receiving opening in the glove;

(k) a ball-catching pocket located between said heel and said web of the glove;

(l) an inverted V-shaped notch in said front panel positioned at the center of said heel and extending from a bottom edge of the front panel adjacent to said hand receiving opening upward toward the ball-catching pocket.

2. A glove as set forth in claim 1, wherein the glove additionally comprises a notch covering affixed to the front panel to cover the notch.

3. A glove as set forth in claim 2, wherein said notch covering is made of a flexible material.

4. A glove as set forth in claim 3, wherein said notch covering is comprised of two sheets of flexible material with foam padding therebetween.

5. A glove as set forth in claim 4, wherein said notch covering is comprised of a flexible material selected from the group consisting of leather and vinyl.

6. A baseball or softball glove having top, bottom and opposing sides, said glove comprising:

(a) a front panel forming the front wall of the glove, wherein said front panel has an outside face and an inside face;

(b) a palm liner corresponding in shape to the front panel and positioned against the inside face of the front panel for contact with the palm of a user;

(c) a back panel forming the back wall of the glove, wherein the front and back panels are secured together along peripheral edges to form an enclosed glove shell having a thumb stall for receiving a thumb of a user, at least one finger stall for receiving one or more fingers of a user and a hand receiving opening formed between a bottom edge of the front and back panels to enable a user to insert his/her hand into the glove;

(d) a web located between the thumb stall and said finger stall;

(e) a heel extending along a bottom of said front panel and said palm liner between opposing sides of the glove and adjacent the hand receiving opening in the glove;

(f) a ball-catching pocket located between said heel and said web of the glove;

(g) an inverted V-shaped notch in the front panel and the palm liner positioned at the center of said heel, said notch extending from a bottom edge of the front panel and palm liner adjacent the hand receiving opening and extending upward toward the ball-catching pocket.

7. A glove as set forth in claim 6, wherein said inverted V-shaped notch cooperates with flexing means for enabling the glove to readily flex along a flex line extending up from the apex of said notch generally midway between the opposing sides of said glove and through the ball-catching pocket.

8. A glove as set forth in claim 7, wherein said flexing means comprise two lines of fastening lacing stitched through the front panel and palm liner and extending diagonally up from the heel of the glove in a generally V-shaped formation with each line of lacing on opposite sides of the ball-catching pocket.

9. A glove as set forth in claim 8, wherein said flexing means cooperates to form said flex line to maintain the ball-catching pocket and facilitate closure of the glove along a generally center line of the glove.

10. A glove as set forth in claim 9, wherein said flex line is a substantially straight line.

11. A glove as set forth in claim 6, wherein the heel has little or no padding to further facilitate opening or closing of the glove.

12. A glove as set forth in claim 6, wherein the inverted V-shaped notch has a notch covering affixed between the front panel and palm liner to cover the notch and shield the part of the user's hand exposed by said notch from blows when fielding balls.

13. A glove as set forth in claim 12, wherein said notch covering is made of a flexible material.

14. A glove as set forth in claim 13, where said notch covering is comprised of two sheets of flexible material with foam padding therebetween.

15. A glove as set forth in claim 14, wherein said notch covering is comprised of a flexible material selected from the group consisting of leather and vinyl.

16. A glove as set forth in claim 15, wherein the bottom edges of said front panel and palm lining are secured together.

* * * * *

UNITED STATES PATENT AND TRADEMARK OFFICE

CERTIFICATE OF CORRECTION

PATENT NO. : 5,799,327
DATED : September 1, 1998
INVENTOR(S) : Robert L. Clevenhagen It is certified that error appears in the above-identified patent and that said Letters Patent is hereby corrected as shown below:

In the Background of the Invention, column 1, line 30 of the Patent "ball-cathching" should be deleted and "ball-catching" should be inserted.

In the Background of the Invention, column 1, line 45 "ball-cathching" should be deleted and "ball-catching" should be inserted.

In the Summary of the Invention, column 1, line 66 after —notch with front— "and back" should be inserted.

In the Summary of the Invention, column 1, line 67 after —in the front— "and back" should be deleted.

In the Summary of the Invention, column 1, line 67 after —panel— "an" should be deleted and "and" should be inserted.

In Claim 1, column 4, line 32 after —finger— "shall" should be deleted and "stall" should be inserted.

UNITED STATES PATENT AND TRADEMARK OFFICE

CERTIFICATE OF CORRECTION

PATENT NO. : 5,799,327
DATED : September 1, 1998
INVENTOR(S) : Robert L. Clevenhagen It is certified that error appears in the above-identified patent and that said Letters Patent is hereby corrected as shown below:

In Claim 16, column 6, line 26 after —claim— "15" should be deleted and "6" should be inserted.

Signed and Sealed this

Twelfth Day of January, 1999

*Attest:*

*Attesting Officer*

*Acting Commissioner of Patents and Trademarks*